US007730895B2

(12) United States Patent
Maddocks et al.

(10) Patent No.: US 7,730,895 B2
(45) Date of Patent: Jun. 8, 2010

(54) ROTARY LOCK MEMBER FOR A HAIR STYLING APPLIANCE

(75) Inventors: Thomas C. Maddocks, Racine, WI (US); Yiu Kwong Wan, Tsuen Wan (HK)

(73) Assignee: Andis Company, Sturtevant, WI (US)

( * ) Notice: Subject to any disclaimer, the term of this patent is extended or adjusted under 35 U.S.C. 154(b) by 553 days.

(21) Appl. No.: 11/684,954

(22) Filed: Mar. 12, 2007

(65) Prior Publication Data

US 2008/0223394 A1 Sep. 18, 2008

(51) Int. Cl.
*A45D 1/00* (2006.01)

(52) U.S. Cl. ..... 132/224

(58) Field of Classification Search ..... 132/224, 132/118, 232, 220, 222, 223, 226, 271, 117; 219/225, 230, 222, 223, 224
See application file for complete search history.

(56) References Cited

U.S. PATENT DOCUMENTS

| | | | | |
|---|---|---|---|---|
| 1,609,810 | A | 12/1926 | Gates | |
| 1,959,420 | A | 5/1934 | Gjeruldsen | |
| 3,775,846 | A | 12/1973 | Johnson | |
| 4,442,849 | A | 4/1984 | Kawabe | |
| 4,561,455 | A | 12/1985 | Pajak | |
| 4,565,916 | A | 1/1986 | Tsuji et al. | |
| 4,739,151 | A | 4/1988 | Smal | |
| 5,223,694 | A | 6/1993 | Tsuji et al. | |
| 6,070,596 | A | 6/2000 | Altamore | |
| 6,581,809 | B1 | 6/2003 | McElhinney | |
| 6,667,462 | B2 | 12/2003 | Lo | |
| 6,920,886 | B2 | 7/2005 | McCambridge et al. | |
| D511,862 | S | 11/2005 | Chan | |
| 2005/0022836 | A1 | 2/2005 | Tong | |
| 2006/0076032 | A1 | 4/2006 | Fung | |
| 2008/0142030 | A1 * | 6/2008 | Venere et al. | 132/116 |
| 2008/0216859 | A1 * | 9/2008 | Chan | 132/224 |

* cited by examiner

*Primary Examiner*—Robyn Doan
*Assistant Examiner*—Brianne E O'Neill
(74) *Attorney, Agent, or Firm*—Michael Best & Friedrich LLP

(57) ABSTRACT

A hair styling appliance includes a first arm and a second arm pivotable with respect to the first arm, wherein the second arm is movable between an open position and a closed position. A gap is positioned between the first arm and the second arm, and a lock member is movable into and out of the gap between a locked position and an unlocked position. In the locked position, the lock member holds the second arm in the closed position.

16 Claims, 7 Drawing Sheets

ROTARY LOCK MEMBER FOR A HAIR STYLING APPLIANCE

BACKGROUND

The present invention relates generally to hair styling devices or applications, and more particularly to hair styling irons.

Some hair styling devices and appliances typically have one or more pieces that move with respect to one another. For instance, a hair flat iron, crimper, styling iron or the like typically includes two arms with heated plates on abutting surfaces such that a user's hair can be pressed between the plates to style the user's hair. Multiple moving pieces makes device storage difficult and leads to longer heating times for the heated surfaces. One example of a lock used with such devices is generally located in a vertical plane, which can rotate freely to inadvertently lock the device when the device is in an unlocked position. Cumbersome locks and buttons makes it difficult to adequately store the devices when not in use.

SUMMARY

In one embodiment, the invention provides a hair styling appliance. The hair styling appliance includes a first arm and a second arm pivotable with respect to the first arm, wherein the second arm is movable between an open position and a closed position. The appliance also includes a gap positioned between the first arm and the second arm, and a lock member movable into and out of the gap between a locked position and an unlocked position. In the locked position, the lock member holds the second arm in the closed position.

In another embodiment, the invention provides a hair styling appliance. The hair styling appliance includes a first arm and a second arm pivotable with respect to the first arm. A spring-loaded pivot couples the first arm and the second arm, wherein the spring-loaded pivot biases the second arm away from the first arm. A lock member is movable between a locked position to hold the first and second arms together and an unlocked position to release the second arm via the spring-loaded pivot.

In yet another embodiment, the invention provides a hair styling appliance. The hair styling appliance includes a first arm defining a styling area and a second arm defining a styling area. The second arm is pivotable with respect to the first arm, wherein the second arm is movable between a closed position in which the first and second arms are generally aligned together at the styling areas and an open position in which the second arm is spaced apart from the first arm. A spring-loaded pivot couples the second arm to the first arm and the spring-loaded pivot is operable to bias the second arm away from the first arm. The appliance includes a gap positioned between the first arm and the second arm, and a lock member rotatable between a locked position, in which the second arm is held in the closed position, and an unlocked position, in which the second arm is released to the open position. The lock member includes a knob portion slidingly coupled to a lock platform.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

A hair flat iron generally has two arms with heated plates on abutting surfaces such that a user's hair may be pressed between the plates to straighten the user's hair. FIGS. 1-4 illustrate a hair flat iron 10 and a rotary lock member 14. In the illustrated embodiment, the lock member 14 rotates in a generally horizontal plane and requires a force to move the lock member 14, which allows for convenient locking of the hair flat iron 10. It should be readily evident to one of ordinary skill in the art that the present invention may also be utilized with other hair styling devices, including a hair crimping iron, a hair styling iron, a hair curling iron, or the like.

Figure 1:
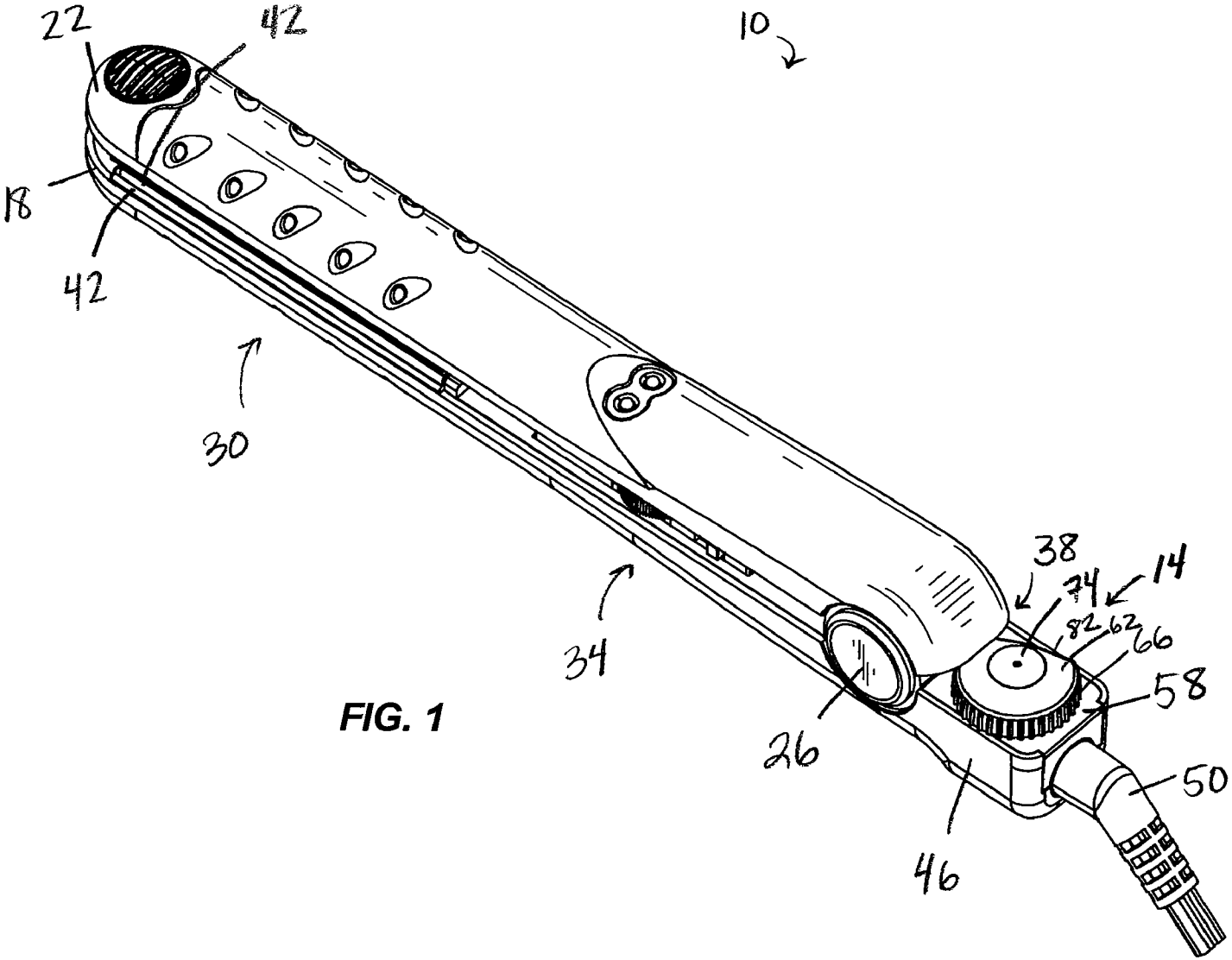
FIG. 1 is a top perspective view of a hair flat iron in a locked position including a rotary lock member embodying various features of the invention.
Figure 2:
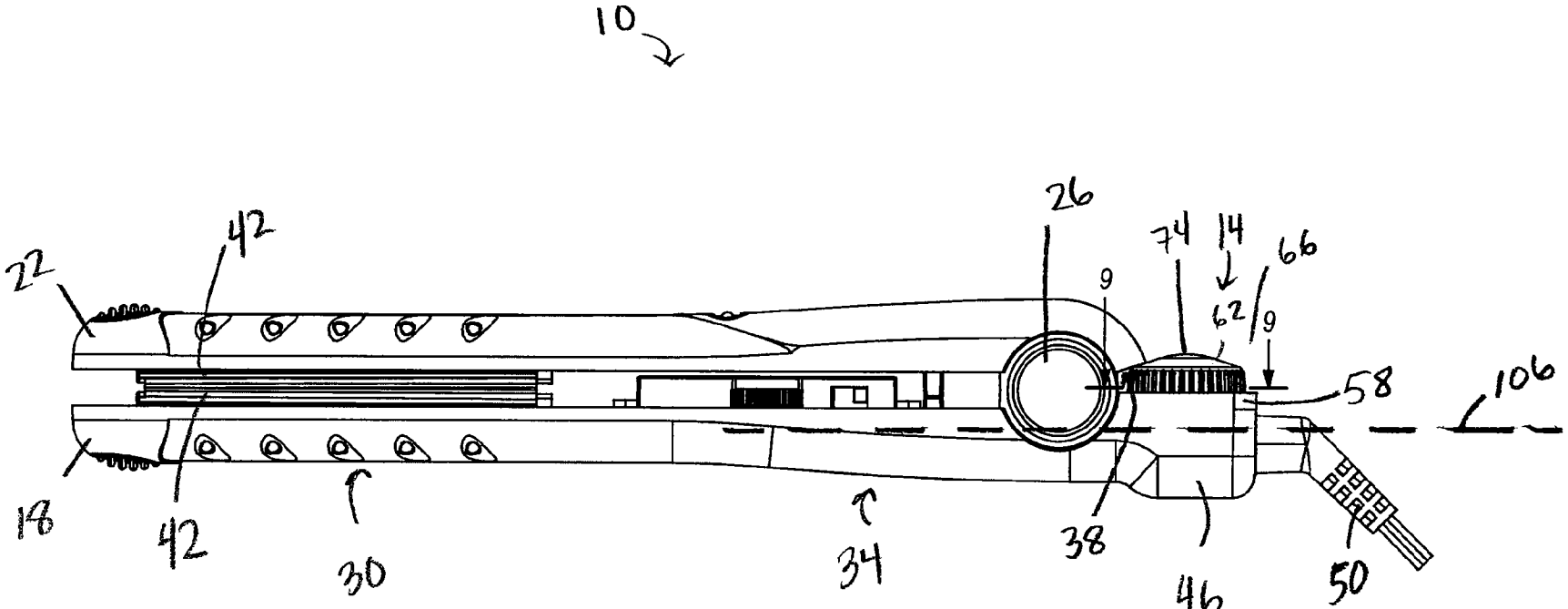
FIG. 2 is a side perspective view of the hair flat iron shown in FIG. 1.

Referring to FIGS. 1-4, the hair flat iron 10 includes a first arm 18 and a second arm 22 pivotably coupled to the first arm 18 at a spring-loaded pivot 26. The hair flat iron 10 further includes a styling area 30, a handle area 34, and a gap 38. The styling area 30 and handle area 34 are defined by both the first arm 18 and the second arm 22. In the illustrated embodiment, the styling area 30 includes two heat transmitting plates 42. A heat transmitting plate 42 is positioned on opposed surfaces of the first arm 18 and the second arm 22, such that the plates 42 are generally aligned and abut when the first arm 18 and the second arm 22 are in a closed position (FIGS. 1 and 2).

The gap 38 is positioned proximate the handle area 34 and the pivot 26, with the gap 38 defined by a space between the first arm 18 and the second arm 22. The first arm 18 includes a rear portion 46, whereby the pivot 26 and the gap 38 are positioned proximate the rear portion 46. The lock member 14 is configured to sit on the rear portion 46 of the first arm 18 proximate the gap 38.

The first arm 18 and second arm 22 may be constructed in various ways and, in the illustrated construction, include a similarly constructed first arm 18 and an opposite second arm 22. The first arm 18 and the second arm 22 may be constructed from numerous materials, including but not limited to, plastic, metal and the like. The heat transmitting plates 42 may be constructed from numerous materials, including but not limited to, metal and the like.

The spring-loaded pivot 26 couples the first arm 18 and the second arm 22 together proximate the handle area 34. The spring-loaded pivot 26 operates to bias the second arm 22 away from the first arm 18 such that the first arm 18 and the second arm 22 are in an open position. It should be readily apparent to those of skill in the art that in further embodiments other means may be used for coupling the first and second arms 18, 22 together and/or biasing the second arm 22 away from the first arm 18.

Figure 3:
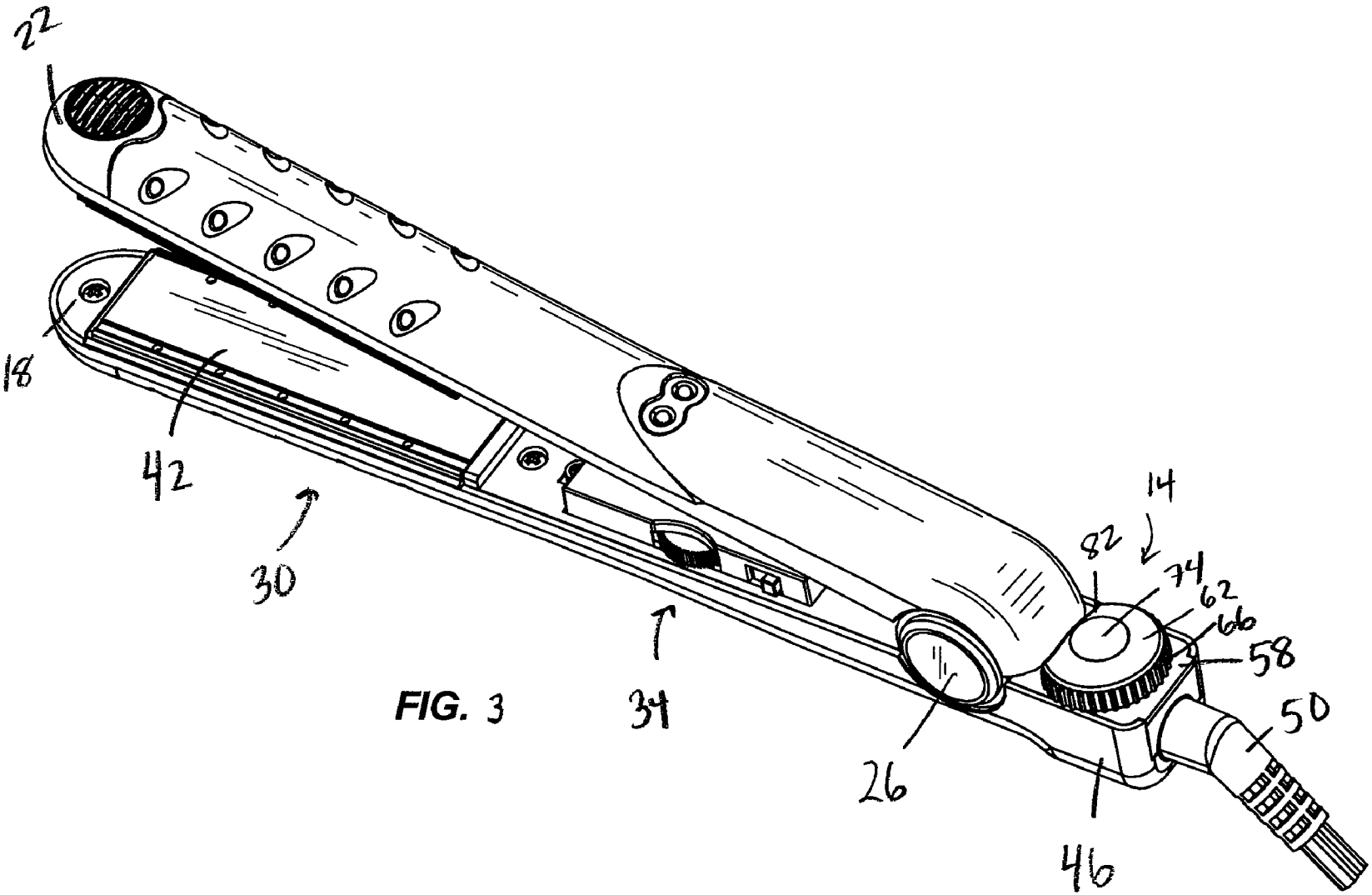
FIG. 3 is a top perspective view of the hair flat iron shown in FIG. 1 in an unlocked position.
Figure 4:
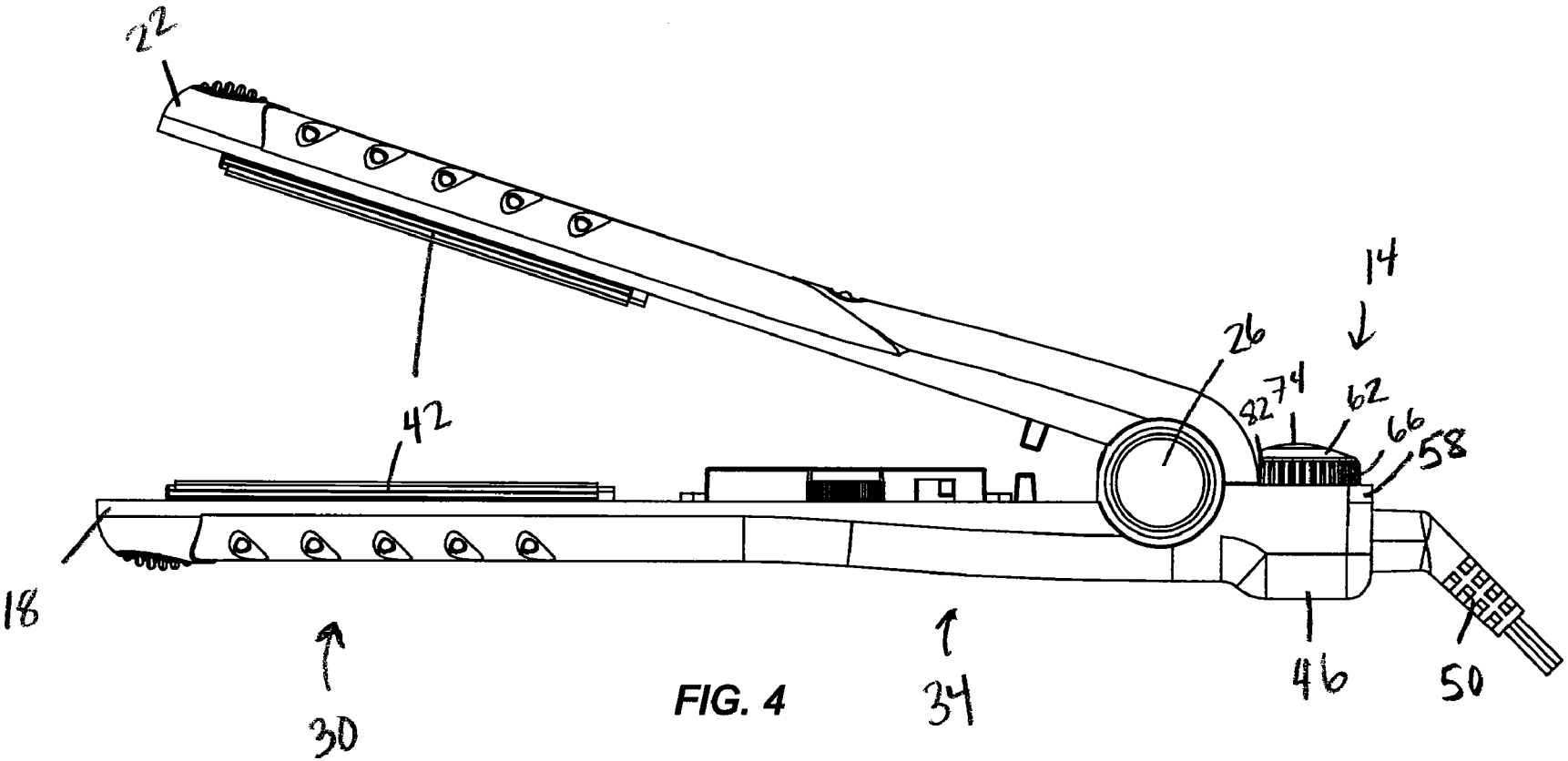
FIG. 4 is a side perspective view of the hair flat iron shown in FIG. 3.

Referring to FIGS. 3 and 4, in the open position, the first arm 18 and the second arm 22 are positioned such that the heat transmitting plates 42 are spaced apart. The open position allows a user to insert hair between the plates 42 to be styled. To move the second arm 22 to the closed position, an operator forces the second arm 22 towards the first arm 18 to overcome the bias of the pivot 26. Referring to FIGS. 1 and 2, in the closed position, the heat transmitting plates 42 of the first and second arms 18, 22 abut together to style hair captured therebetween. In the closed position, no further hair may be inserted between the plates 42.

The hair flat iron 10 includes an electrical cord 50 extending from the rear portion 46 of the hair flat iron 10 for electrically connecting the hair flat iron 10 to an external power source (not shown). The electrical power includes an alternating current (AC) power provided via a corded plug electrically coupled to a wall outlet. In a further embodiment, direct current (DC) power provided by a battery (e.g., a rechargeable battery disposed in the handle or housing of the hair grooming device). Hair styling devices powered by AC and/or DC power are generally known in the art and, accordingly, are not discussed further herein.

As discussed above, the hair flat iron 10 includes the lock member 14, which is configured for positioning within the gap 38 between the first arm 18 and the second arm 22. To lock the hair flat iron 10 in the closed position (FIGS. 1 and 2), the lock member 14 is positioned (e.g., by rotating) between the first arm 18 and the second arm 22, i.e., within the gap 38. To unlock the hair flat iron 10, the lock member 14 is positioned (e.g., by rotating) such that no portion of the lock member 14 is located within the gap 38. When the hair flat iron 10 is unlocked, the second arm 22 is biased away from the first arm 18 to the open position (FIGS. 3 and 4).

Referring to FIGS. 5-8, the lock member 14 includes a knob portion 54 and a lock platform 58. The lock platform 58 is coupled to the rear portion 46 of the first arm 18, and the knob portion 54 is positioned on the lock platform 58. For example, in one embodiment, the knob portion 54 is slidingly coupled to the lock platform 58. The knob portion 54 may be coupled to the lock platform 58 in a number of manners, including but not limited to, a snap-fit connection, a friction-fit connection, a fastener, or the like.

Figure 5:
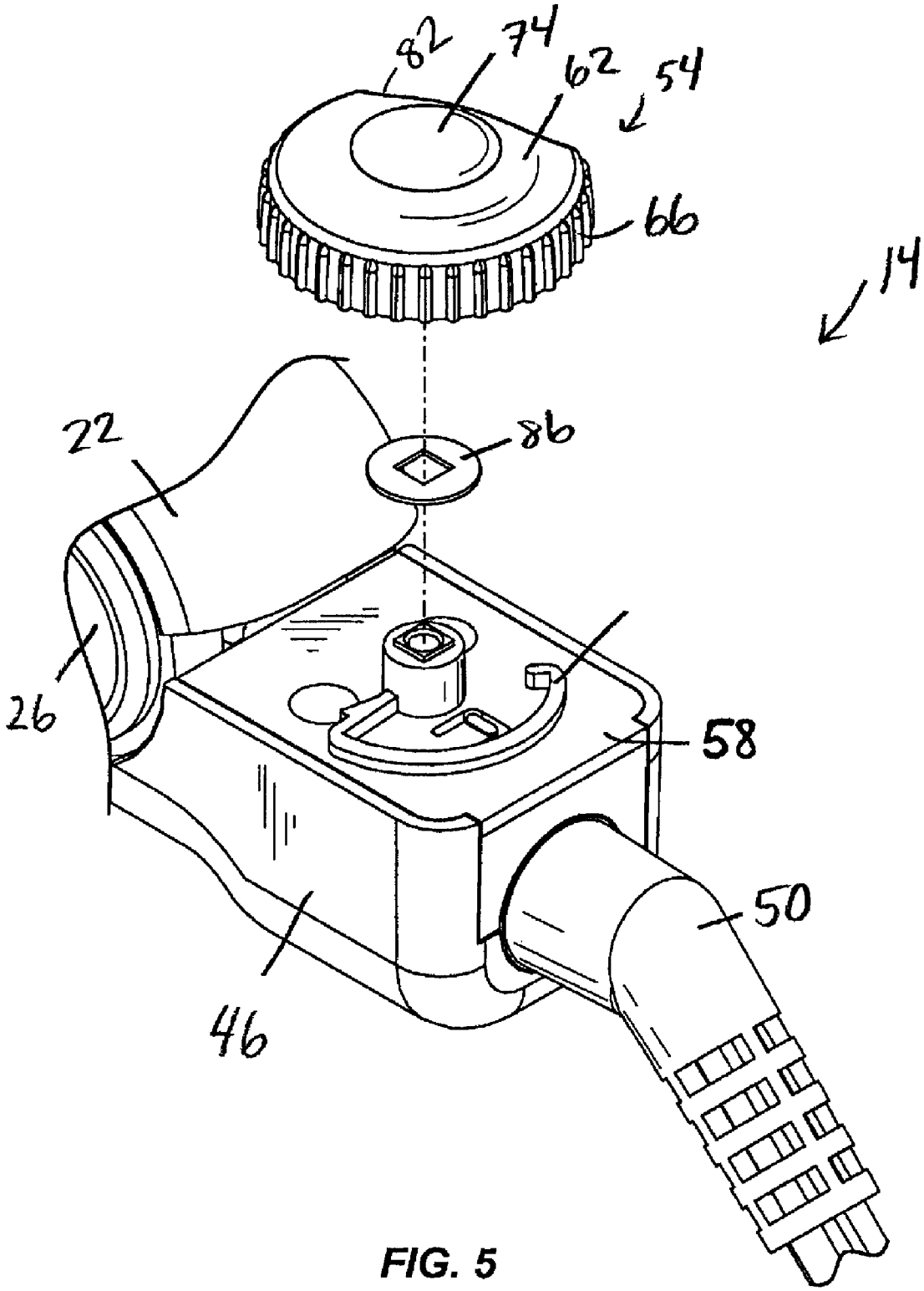
FIG. 5 is an exploded view of the rotary lock member shown in FIG. 1.
Figure 6:
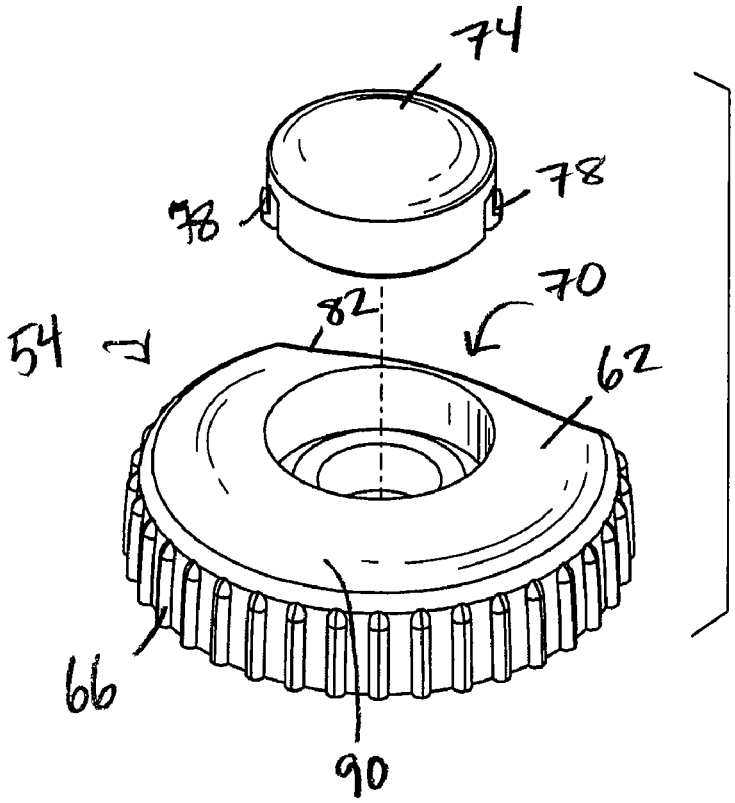
FIG. 6 is an exploded view of a knob portion of the rotary lock member shown in FIG. 1.
Figure 7:
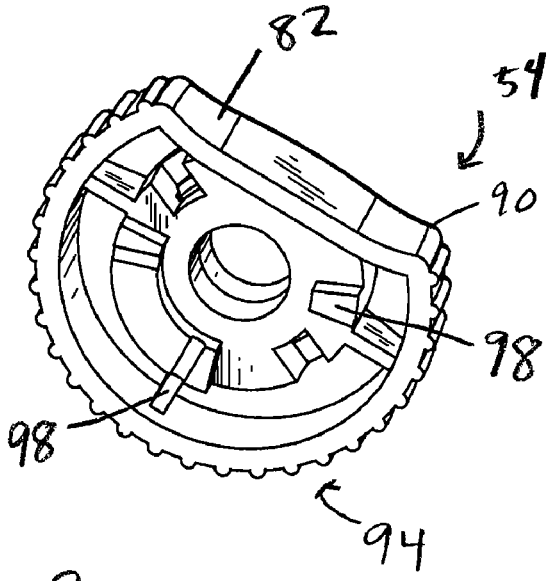
FIG. 7 is a bottom view of the knob portion of the rotary lock member.
Figure 8:
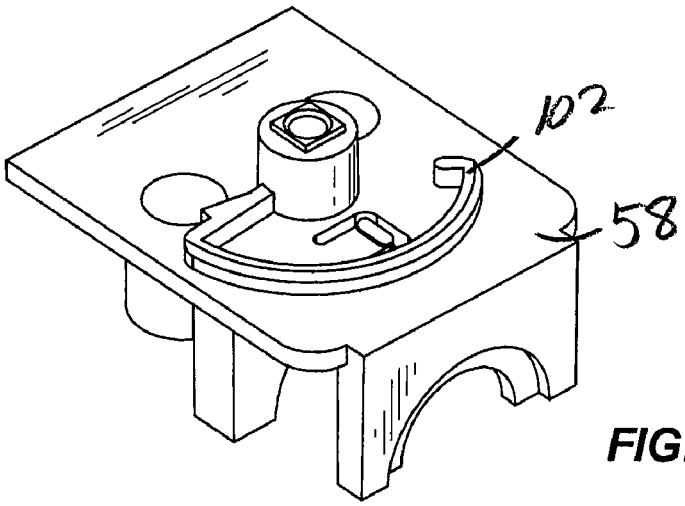
FIG. 8 is a top perspective view of a platform of the hair flat iron shown in FIG. 1.

As illustrated in FIGS. 5 and 6, the knob portion 54 includes an actuation member 62 having a plurality of ridges 66 about an outer periphery and defining a central aperture 70. The central aperture 70 receives a top cap 74 having latches 78 to couple the cap 74 to the actuation member 62. The ridges 66 aid a user in manipulating (e.g., rotating) the lock member 14 to provide the force necessary to move the lock member 14 into and out of the gap 38. Though the illustrated embodiment shows ridges 66, the knob portion 54 may include other means for manipulation, including, but not limited to tabs, buttons and the like.

In the illustrated embodiment, the knob portion 54 has a generally circular shape and includes a cut-away portion that generally forms a straight edge 82. The knob portion 54 is configured and shaped to fit within the gap 38 between the first arm 18 and the second arm 22. In one embodiment, the knob portion 54 wedges into the gap 38. The lock member 14 also includes a washer 86 positioned between the knob portion 54 and the lock platform 58 wherein the washer 86 maintains tightness and relieves friction between the knob portion 54 and the lock platform 58.

The actuation member 62 of the knob portion 54 includes an upper surface 90, a bottom surface 94, and flanges 98 extending from the bottom surface 94. The flanges 98 of the knob portion 54 are configured to interact with the lock platform 58 such that the flanges 98 of the knob portion 54 sit adjacent the lock platform 58 when the knob portion 54 is positioned in its standard operating position. Specifically and with reference to FIGS. 6-9, the flanges 98 slide relative to a locking brace 102 extending from the lock platform 58 as the lock member 14 rotates between the locked and unlocked positions. The flanges 98 prevent over-rotation of the lock member 14 and also allow the lock member 14 to operate within a set range of motion. For example, in one embodiment, the lock member 14 rotates less than 360 degrees.

Figure 9:
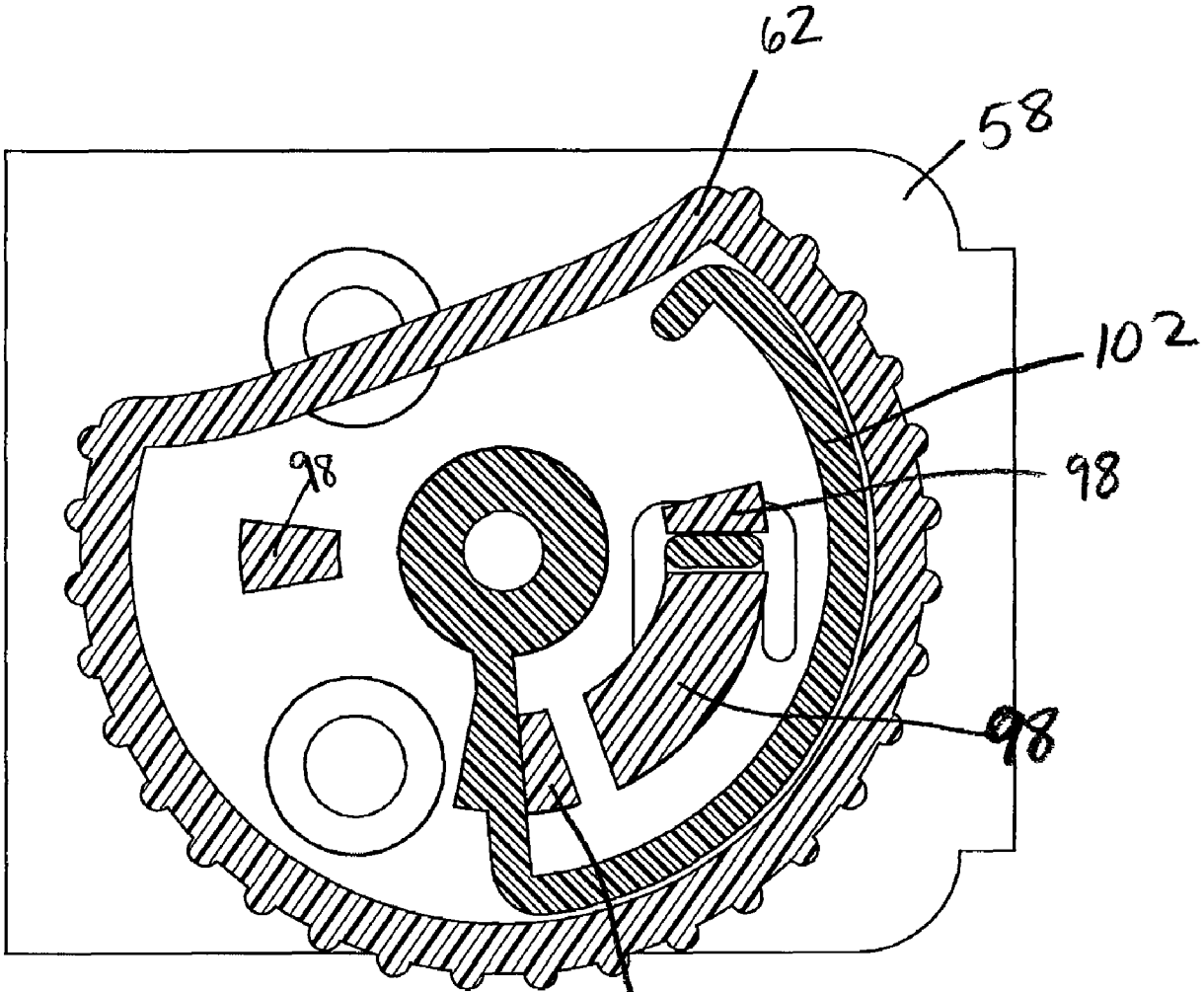
FIG. 9 is a cross-sectional view of the rotary lock member taken along line 9-9 of FIG. 2.

As further illustrated in FIG. 9, the knob portion 54 sits adjacent the lock platform 58 and slidingly engages the lock platform 58. In particular, the locking brace 102 rides inside the actuation member 62 while the flanges 98 of the knob portion 54 slide inside the locking brace 102. To prevent over-rotation of the lock member 14, when the flanges 98 engage or abut the locking brace 102, rotation of the lock member 14 is stopped.

In the illustrated embodiment, the lock member 14 is oriented generally parallel with a plane 106 defined by the first arm 18 (FIG. 2). The lock member assembly 14 and its associated components may be made from any number of materials, including, but not limited to plastic, metal and the like. Additionally, the lock member assembly 14 and its associated components may be made by any number of processes, including, but not limited to injection molding, thermoforming, and the like.

In operation, the lock member 14 is rotatable to the locked position whereby the lock member 14 maintains the hair flat iron 10 in the closed position, that is, the first arm 18 and the second arm 22 are held together. Rotating the lock member 14 to the unlocked position releases the hair flat iron 10 and the second arm 22 is biased away from the first arm 18 to the open position. With reference to FIGS. 1-2, when the lock member assembly 14 is rotated to the locked position, the knob portion 54 is positioned within the gap 38 between the first arm 18 and the second arm 22 to hold the hair flat iron 10 in the closed position. As discussed above, the first arm 18 and the second arm 22 are operable via the spring-loaded pivot 26, whereby the spring 26 biases the second arm 22 away from the first arm 18 when there is no impediment to motion of either the first arm 18 or the second arm 22. In the unlocked position, a user may manually move the hair flat iron 10 to the closed position by pressing the second arm 22 toward the first arm 18. When the lock member 14 is positioned within the gap 38, the lock member 14 prevents the spring 26 from biasing the second arm 22 away from the first arm 18. Accordingly, the hair flat iron 10 is locked in the closed position. When in the closed position, the hair flat iron 10 is more conveniently stored and also allows for a faster heat up time of the heat transmitting plates 42 since the heat transmitting plates 42 have less surface area exposed to ambient air.

To adjust the lock member 14 from the locked position to the unlocked position, the lock member 14 is rotated such that the knob portion 54 is positioned out of the gap 38 between the first arm 18 and the second arm 22 (see FIGS. 3-4). In the illustrated embodiment, when the lock member 14 is in the unlocked position, the straight edge 82 of the knob portion 54 is positioned proximate the gap 38. Although the knob portion 54 of the illustrated embodiment has a circular body with the straight edge 82, the knob portion 54 may have any form or shape that allows the lock member assembly 14 to perform the locking operation by selectively positioning a part of the knob portion 54 within the gap 38 between the first arm 18 and the second arm 22.

Other embodiments of the present invention may utilize combinations of the above embodiments. The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the claims.

What is claimed is:

1. A hair styling appliance comprising:

a first arm having a pivot end and a facing surface;

a second arm having a pivot end and a facing surface, the second arm coupled to the first arm such that the facing surfaces of the arms face each other, and the second arm movable with respect to the first arm about a pivot wherein the second arm is movable between an open position and a closed position, the second arm having a longitudinal dimension that is smaller than a longitudinal dimension of the first arm;

wherein the pivot end of the first arm extends beyond the pivot and the pivot end of the second arm;

a gap positioned between the facing surface of the first arm and the facing surface of the second arm; and a lock member positioned on the pivot end of the first arm beyond the pivot and extending from the facing surface of the first arm, the lock member movable into and out of the gap between a locked position and an unlocked position, wherein in the locked position, the lock member holds the second arm in the closed position wherein the lock member includes a knob portion that is positioned on a lock platform, the knob portion including at least one flange configured to slide relative to a locking brace of the lock platform and to engage a portion of the locking brace to prevent over-rotation of the lock member.

2. The hair styling appliance of claim 1 wherein the lock member is oriented generally parallel with respect to a plane defined by the facing surface of the first arm.

3. The hair styling appliance of claim 1 wherein the lock member is rotatable about an axis perpendicular to a plane defined by the facing surface of the first arm to move between the locked position and the unlocked position.

4. The hair styling appliance of claim 1 wherein in the locked position, the lock member is positioned within the gap.

5. The hair styling appliance of claim 1 wherein in the unlocked position, the lock member is positioned proximate the gap to maintain the second arm in the open position.

6. A hair styling appliance, the hair styling appliance comprising:

a first arm having a pivot end;

a second arm having a pivot end and being pivotable with respect to the first arm, the second arm having a longitudinal dimension that is smaller than a longitudinal dimension of the first arm;

a spring-loaded pivot for coupling the first arm and the second arm such that a portion of the pivot end of the first arm extends beyond the pivot end of the second arm, wherein the spring-loaded pivot biases the second arm away from the first arm; and a lock member including a lock platform located at the portion of the pivot end of the first arm extending beyond the pivot end of the second arm and a knob portion positioned on the lock platform and extending from the lock platform in the direction away from the first arm, the knob portion slidably coupled to the lock platform and movable between a locked position to hold the first and second arms together and an unlocked position to release the second arm by the spring-loaded pivot, wherein the knob portion includes at least one flange configured for sliding relative to a locking brace of the lock platform, and further wherein the at least one flange engages a portion of the locking brace to prevent over-rotation of the lock member.

7. The hair styling appliance of claim 6 wherein the knob portion includes an upper surface with the at least one flange extending from the upper surface in the direction of the lock platform.

8. The hair styling appliance of claim 6, and further comprising a gap between the first arm and the second arm wherein the gap is positioned proximate the lock member, and the knob portion is movable into and out of the gap.

9. The hair styling appliance of claim 8, wherein the knob portion rotates about an axis and includes an outer periphery having at least two different radial dimensions, such that when the lock member is in the locked position, a portion of the leek knob portion having a greater radial dimension is positioned within the gap.

10. The hair styling appliance of claim 8, wherein the knob portion rotates about an axis and includes an outer periphery having at least two different radial dimensions, such that when the lock member is in the unlocked position, a portion of the knob portion having a smaller radial dimension is positioned proximate the gap.

11. The hair styling appliance of claim 6, wherein the knob portion is oriented to rotate in a plane generally parallel with respect to a plane defined by the first arm that includes the lock platform.

12. A hair styling appliance, the hair styling appliance comprising:

a first arm including pivot end and a facing surface defining a styling area;

a second arm including a pivot end and a facing surface defining a styling area, the second arm pivotable with respect to the first arm, wherein the second arm is movable between a closed position in which the first and second arms are generally aligned together at the styling areas and an open position in which the second arm is spaced apart from the first arm, the second arm having a longitudinal dimension that is smaller than a longitudinal dimension of the first arm;

a spring-loaded pivot coupling the second arm to the first arm at a position between the styling area and the pivot end of the first arm such that such that a portion of the pivot end of the first arm extends beyond the pivot end of the second arm, the spring-loaded pivot operable to bias the second arm away from the first arm;

a gap positioned between the facing surface of the first arm and the facing surface of the second arm; and a lock member including a knob portion positioned on the portion of pivot end of the first arm beyond the pivot and a lock platform defined by the facing surface of the first arm, the knob portion coupled to and extending from the lock platform and the knob portion rotatable between a locked position, in which the second arm is held in the closed position, and an unlocked position, in which the second arm is released to the open position, wherein the knob portion includes at least one flange configured to slide relative to a locking brace of the lock platform and prevent over-rotation of the lock member.

13. The hair styling appliance of claim 12, wherein the knob portion includes an upper surface with the at least one flange extending from the upper surface in the direction of the lock platform, the at least one flange configured to engage a portion of the locking brace.

14. The hair styling appliance of claim 12, wherein the knob portion is oriented to rotate in a plane generally parallel with respect to a plane defined by the lock platform.

15. The hair styling appliance of claim 12, wherein the knob portion rotates about an axis that is generally perpendicular to the lock platform, and in the locked position, the knob portion is positioned within the gap.

16. The hair styling appliance of claim 12, wherein the knob portion rotates about an axis that is generally perpendicular to the lock platform, and in the unlocked position, the knob portion is positioned proximate the gap to maintain the second arm in the open position.

* * * * *

UNITED STATES PATENT AND TRADEMARK OFFICE

CERTIFICATE OF CORRECTION

PATENT NO. : 7,730,895 B2
APPLICATION NO. : 11/684954
DATED : June 8, 2010
INVENTOR(S) : Thomas C. Maddocks and Yiu Kwong Wan It is certified that error appears in the above-identified patent and that said Letters Patent is hereby corrected as shown below:

Claim 1, column 5, line 36, "position wherein" should be --position, wherein--

Claim 9, column 6, line 27, delete "leek"

Claim 12, column 6, line 54, delete first occurrence of "such that"

Signed and Sealed this
First Day of February, 2011

David J. Kappos

David J. Kappos
*Director of the United States Patent and Trademark Office*